US008083504B2

(12) United States Patent
Williams et al.

(10) Patent No.: US 8,083,504 B2
(45) Date of Patent: Dec. 27, 2011

(54) QUINTUPLEX MUD PUMP

(75) Inventors: Ellis Williams, Magnolia, TX (US); Michael R. Williams, Magnolia, TX (US); Jason C. Williams, Magnolia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 698 days.

(21) Appl. No.: 12/244,946

(22) Filed: Oct. 3, 2008

(65) Prior Publication Data

US 2009/0092510 A1 Apr. 9, 2009

Related U.S. Application Data

(60) Provisional application No. 60/977,956, filed on Oct. 5, 2007.

(51) Int. Cl.
*F04B 23/04* (2006.01)

(52) U.S. Cl. ..... 417/522; 417/523; 417/273

(58) Field of Classification Search ..... 417/521, 417/522, 523, 269, 273
See application file for complete search history.

(56) References Cited

U.S. PATENT DOCUMENTS

| | | | |
|---|---|---|---|
| 3,595,101 | A | 7/1971 | Cooper |
| 4,032,265 | A | 6/1977 | Miller |
| 4,305,311 | A | 12/1981 | McGill |
| 5,246,355 | A | 9/1993 | Matzner |
| 5,839,888 | A | 11/1998 | Harrison |
| 2004/0213677 | A1 | 10/2004 | Matzner et al. |
| 2004/0219042 | A1 | 11/2004 | Kugelev et al. |
| 2007/0099746 | A1 | 5/2007 | Hahlbeck |

OTHER PUBLICATIONS

International Search Report & Written Opinion for PCT/US2008/078720, dated Dec. 2, 2008.
Kury; "A well-service pump with a new dimension—use of a quintuplex well service pump as a mud pump;" World Oil; Jun. 1998.
World Oil; "Mud Pump Brochure;" Jan. 2006.
"Triplex Mud Pumps Triplex Mud Pump Parts;" copyright 2007 Sunnda LLC; downloaded from http://www.triplexmudpump.com/F-series-triplex-mud-pumps-power-end.php on Sep. 5, 2008.
"103Q-3 Quintuplex Plunger Pump;" Product Information Brochure; National Oilwell Varco.
National Oilwell Varco; "Multiplex Plunger Pumps: Installation, Care and Operation Manual;" Product Information Brochure; Issued Mar. 1, 2000.
Gardner Denver; "HD-2250 Well Service Pump: Power End Parts List;" Product Information Brochure; Apr. 2005.
CryoStar; "HPP Reciprocating Quintuplex Pump;" Product Information Brochure; undated.
"Triplex Mud Pumps Triplex Mud Pump Parts for Sale;" copyright 2007 Sunnda LLC; Product Information Brochure located at http://www.triplexmudpump.com/.

(Continued)

*Primary Examiner* — Vip Patel
(74) *Attorney, Agent, or Firm* — Wong, Cabello, Lutsch, Rutherford & Brucculeri, LLP

(57) ABSTRACT

A quintuplex mud pump has a crankshaft supported in the pump by external main bearings. The crankshaft has five eccentric sheaves, two internal main bearing sheaves, and two bull gears. Each of the main bearing sheaves supports the crankshaft by a main bearing. One main bearing sheave is disposed between second and third eccentric sheaves, while the other main bearing sheave is disposed between third and fourth eccentric sheaves. One bull gear is disposed between the first and second eccentric sheaves, while the second bull gear is disposed between fourth and fifth eccentric sheaves. A pinion shaft has pinion gears interfacing with the crankshaft's bull gears. Connecting rods on the eccentric sheaves use roller bearings and transfer rotational movement of the crankshaft to pistons of the pump's fluid assembly.

35 Claims, 7 Drawing Sheets

OTHER PUBLICATIONS

Dixie Iron Works, Ltd.; "MSI QI-1000: Technical Manual for 1000 HP Quintuplex MSI QI-1000 Pump;" Product Information Brochure; May 2006.
National Oilwell; "Triplex Mud Pumps;" Product Information Brochure; downloaded from http://nql.com/Archives/2000%20Composite%20Catalog/pg_32.html downloaded on Sep. 5, 2008.
MSI; "QI-1000 Compact Well Service Pump;" Product Information Brochure; undated.
China Petrochemical International Co., Ltd.; "Quintuplex Mud Pump;" Product Information Brochure downloaded from http://www.intl.sinopec.com.cn/emExp/upstream/Quituplex_Mud_Pump.htm downloaded on Oct. 2, 2008.
"Timken Engineering Journal: Oil Field Equipment Section;" The Timken Roller Bearing Company; Product Information Brochure; undated.
"Triplex Mud Pump Parts and Accessories;" Product Information Brochure; copyright 2007 Sunnda LLC; downloaded from http://www.triplexmudpump.com/triplex-mud-pump-parts.php on Sep. 5, 2008.
"Union Engineering Handbook: Pumping Machuinery Compressors Condensers;" Union Steam Pump Co.; copyright 1921.
Union Pump Company; "QD 7000 Quituplex"; undated.
FMC Technologies; "Fluid Control: Well Service Pump;" Product Information Brochure; downloaded from http://www.fmctechnologies.com/_FluidControl_old/WellServicePump.aspx on Sep. 5, 2008.
FMC Technologies; "Well Service Pump: Superior Performance and Durability for Rugged Applications;" Product Information Brochure; undated.
FMC Technologies; "Well Service Pump: Superior Performance and Durability for Rugged Applications;" Specification Sheet; undated.
Office Action in counterpart Canadian Appl. No. 2,696,683, dated Sep. 21, 2011.

QUINTUPLEX MUD PUMP

CROSS-REFERENCE TO RELATED APPLICATIONS

This is a non-provisional of U.S. Provisional Appl. Ser. No. 60/977,956, filed 5, Oct. 2007, which is incorporated herein by reference and to which priority is claimed.

BACKGROUND

Triplex mud pumps pump drilling mud during well operations. An example of a typical triplex mud pump 10 shown in FIG. 1A has a power assembly 12, a crosshead assembly 14, and a fluid assembly 16. Electric motors (not shown) connect to a pinion shaft 30 that drives the power assembly 12. The crosshead assembly 14 converts the rotational movement of the power assembly 12 into reciprocating movement to actuate internal pistons or plungers of the fluid assembly 16. Being triplex, the pump's fluid assembly 16 has three internal pistons to pump the mud.

As shown in FIG. 1B, the pump's power assembly 14 has a crankshaft 20 supported at its ends by double roller bearings 22. Positioned along its intermediate extent, the crankshaft 20 has three eccentric sheaves 24-1 . . . 24-3, and three connecting rods 40 mount onto these sheaves 24 with cylindrical roller bearings 26. These connecting rods 40 connect by extension rods (not shown) and the crosshead assembly (14) to the pistons of the pump's fluid assembly 16.

In addition to the sheaves, the crankshaft 20 also has a bull gear 28 positioned between the second and third sheaves 24-2 and 24-3. The bull gear 28 interfaces with the pinion shaft (30) and drives the crankshaft 20's rotation. As shown particularly in FIG. 1C, the pinion shaft 30 also mounts in the power assembly 14 with roller bearings 32 supporting its ends. When electric motors couple to the pinion shaft's ends 34 and rotate the pinion shaft 30, a pinion gear 38 interfacing with the crankshaft's bull gear 28 drives the crankshaft (20), thereby operating the pistons of the pump's fluid assembly 16.

When used to pump mud, the triplex mud pump 10 produces flow that varies by approximately 23%. For example, the pump 10 produces a maximum flow level of about 106% during certain crankshaft angles and produces a minimum flow level of 83% during other crankshaft angles, resulting in a total flow variation of 23% as the pump's pistons are moved in differing exhaust strokes during the crankshaft's rotation. Because the total flow varies, the pump 10 tends to produce undesirable pressure changes or "noise" in the pumped mud. In turn, this noise interferes with downhole telemetry and other techniques used during measurement-while-drilling (MWD) and logging-while-drilling (LWD) operations.

In contrast to mud pumps, well-service pumps (WSP) are also used during well operations. A well service pump is used to pump fluid at higher pressures than those used to pump mud. Therefore, the well service pumps are typically used to pump high pressure fluid into a well during frac operations or the like. An example of a well-service pump 50 is shown in FIG. 2. Here, the well service pump 50 is a quintuplex well service pump, although triplex well service pumps are also used. The pump 50 has a power assembly 52, a crosshead assembly 54, and a fluid assembly 56. A gear reducer 53 on one side of the pump 50 connects a drive (not shown) to the power assembly 52 to drive the pump 50.

As shown in FIG. 3, the pump's power assembly 52 has a crankshaft 60 with five crankpins 62 and an internal main bearing sheave 64. The crankpins 62 are offset from the crankshaft 60's axis of rotation and convert the rotation of the crankshaft 60 in to a reciprocating motion for operating pistons (not shown) in the pump's fluid assembly 56. Double roller bearings 66 support the crankshaft 60 at both ends of the power assembly 52, and an internal double roller bearing 68 supports the crankshaft 60 at its main bearing sheave 64. One end 61 of the crankshaft 60 extends outside the power assembly 52 for coupling to the gear reducer (53; FIG. 2) and other drive components.

As shown in FIG. 4A, connecting rods 70 connect from the crankpins 62 to pistons or plungers 80 via the crosshead assembly 54. FIG. 4B shows a typical connection of a connecting rod 70 to a crankpin 62 in the well service pump 50. As shown, a bearing cap 74 fits on one side of the crankpin 62 and couples to the profiled end of the connecting rod 70. To reduce friction, the connection uses a sleeve bearing 76 between the rod 70, bearing cap 74, and crankpin 62. From the crankpin 62, the connecting rod 70 connects to a crosshead 55 using a wrist pin 72 as shown in FIG. 4A. The wrist pin 72 allows the connecting rod 70 to pivot with respect to the crosshead 55, which in turn is connected to the plunger 80.

In use, an electric motor or an internal combustion engine (such as a diesel engine) drives the pump 50 by the gear reducer 53. As the crankshaft 60 turns, the crankpins 62 reciprocate the connecting rods 70. Moved by the rods 70, the crossheads 55 reciprocate inside fixed cylinders. In turn, the plunger 80 coupled to the crosshead 55 also reciprocates between suction and power strokes in the fluid assembly 56. Withdrawal of a plunger 80 during a suction stroke pulls fluid into the assembly 56 through the input valve 82 connected to an inlet hose or pipe (not shown). Subsequently pushed during the power stroke, the plunger 80 then forces the fluid under pressure out through the output valve 84 connected to an outlet hose or pipe (not shown).

In contrast to using a crankshaft for a quintuplex well-service pump that has crankpins 62 as discussed above, another type of quintuplex well-service pump uses eccentric sheaves on a direct drive crankshaft. FIG. 4C is an isolated view of such a crankshaft 90 having eccentric sheaves 92-1 . . . 92-5 for use in a quintuplex well-service pump. External main bearings (not shown) support the crankshaft 90 at its ends 96 in the well-service pumps housing (not shown). To drive the crankshaft 90, one end 91 extends beyond the pumps housing for coupling to drive components, such as a gear box. The crankshaft 90 has five eccentric sheaves 92-1 . . . 92-5 for coupling to connecting rods (not shown) with roller bearings. The crankshaft 90 also has two internal main bearing sheaves 94-1, 94-2 for internal main bearings used to support the crankshaft 90 in the pump's housing.

In the past, quintuplex well-service pumps used for pumping frac fluid or the like have been substituted for mud pumps during drilling operations to pump mud. Unfortunately, the well-service pump has a shorter service life compared to the conventional triplex mud pumps, making use of the well-service pump as a mud pump less desirable in most situations. In addition, a quintuplex well-service pump produces a great deal of white noise that interferes with MWD and LWD operations, further making the pump's use to pump mud less desirable in most situations. Furthermore, the well-service pump is configured for direct drive by a motor and gear box directly coupling on one end of the crankshaft. This direct coupling limits what drives can be used with the pump. Moreover, the direct drive to the crankshaft can produce various issues with noise, balance, wear, and other associated problems that make use of the well-service pump to pump mud less desirable.

One might expect to provide a quintuplex mud pump by extending the conventional arrangement of a triplex mud pump (e.g., as shown in FIG. 1B) to include components for two additional pistons or plungers. However, the actual design for a quintuplex mud pump is not as easy as extending the conventional arrangement, especially in light of the requirements for a mud pump's operation such as service life, noise levels, crankshaft deflection, balance, and other considerations. As a result, acceptable implementation of a quintuplex mud pump has not been achieved in the art during the long history of mud pump design.

What is needed is an efficient mud pump that has a long service life and that produces low levels of white noise during operation so as not to interfere with MWD and LWD operations while pumping mud in a well.

DETAILED DESCRIPTION

A quintuplex mud pump is a continuous duty, reciprocating plunger/piston pump. The mud pump has a crankshaft supported in the pump by external main bearings and uses internal gearing and a pinion shaft to drive the crankshaft. Five eccentric sheaves and two internal main bearing sheaves are provided on the crankshaft. Each of the main bearing sheaves supports the intermediate extent of crankshaft using bearings. One main bearing sheave is disposed between the second and third eccentric sheaves, while the other main bearing sheave is disposed between the third and fourth eccentric sheaves.

One or more bull gears are also provided on the crankshaft, and the pump's pinion shaft has one or more pinion gears that interface with the one or more bull gears. If one bull gear is used, the interface between the bull and pinion gears can use herringbone or double helical gearing of opposite hand to avoid axial thrust. If two bull gears are used, the interface between the bull and pinion gears can use helical gearing with each having opposite hand to avoid axial thrust. For example, one of two bull gears can be disposed between the first and second eccentric sheaves, while the second bull gear can be disposed between fourth and fifth eccentric sheaves. These bull gears can have opposite hand. The pump's internal gearing allows the pump to be driven conventionally and packaged in any standard mud pump packaging arrangement. Electric motors (for example, twin motors made by GE) may be used to drive the pump, although the pump's rated input horsepower may be a factor used to determine the type of motor.

Connecting rods connect to the eccentric sheaves and use roller bearings. During rotation of the crankshaft, these connecting rods transfer the crankshaft's rotational movement to reciprocating motion of the pistons or plungers in the pump's fluid assembly. As such, the quintuplex mud pump uses all roller bearings to support its crankshaft and to transfer crankshaft motion to the connecting rods. In this way, the quintuplex mud pump can reduce the white noise typically produced by conventional triplex mud pumps and well service pumps that can interfere with MWD and LWD operations.

Figure 1A:
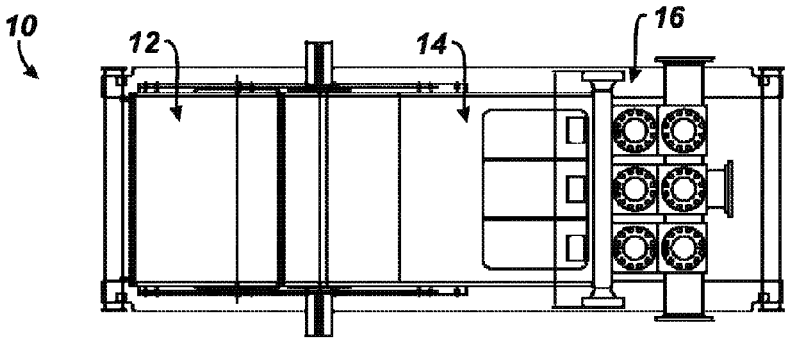
FIG. 1A (Prior Art)
FIG. 1A is a top view of a triplex mud pump according to the prior art.
Figure 1B:
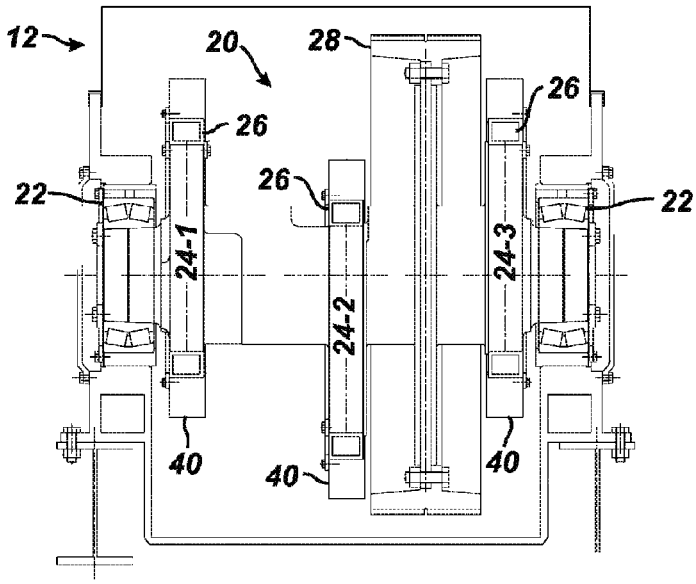
FIG. 1B (Prior Art)
FIG. 1B is a cross-sectional view of the triplex mud pump's power assembly showing the crankshaft.
Figure 1C:
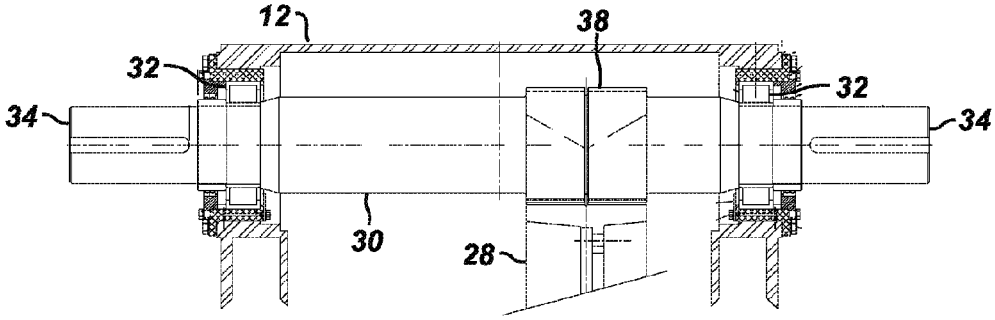
FIG. 1C (Prior Art)
FIG. 1C shows the triplex mud pump's pinion shaft.
Figure 2:
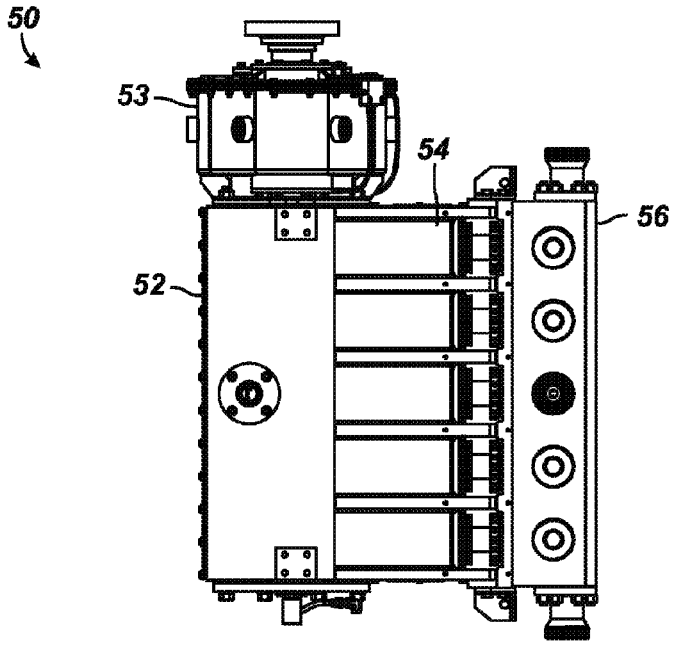
FIG. 2 (Prior Art)
FIG. 2 is a top view of a quintuplex well service pump according to the prior art.
Figure 3:
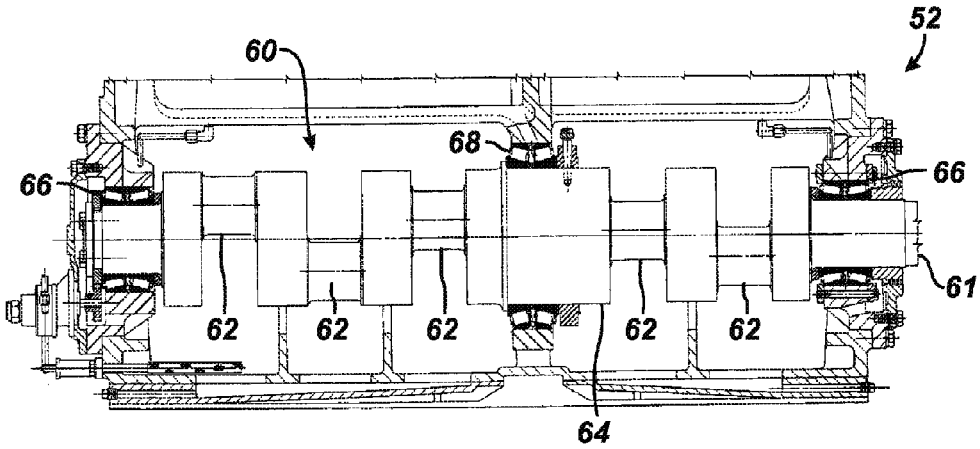
FIG. 3 (Prior Art)
FIG. 3 is an end-sectional view of the power assembly for the quintuplex well service pump in FIG. 2.
Figure 4A:
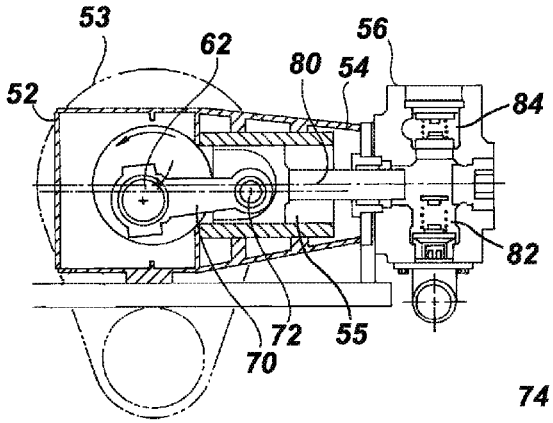
FIG. 4A (Prior Art)
FIG. 4A is a side cross-section of the quintuplex well service pump of FIG. 2.
Figure 4B:
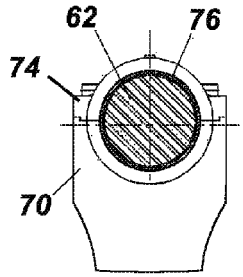
FIG. 4B (Prior Art)
FIG. 4B is a side view of a bearing for a connector rod coupled to the well service pump's crankpin.
Figure 4C:
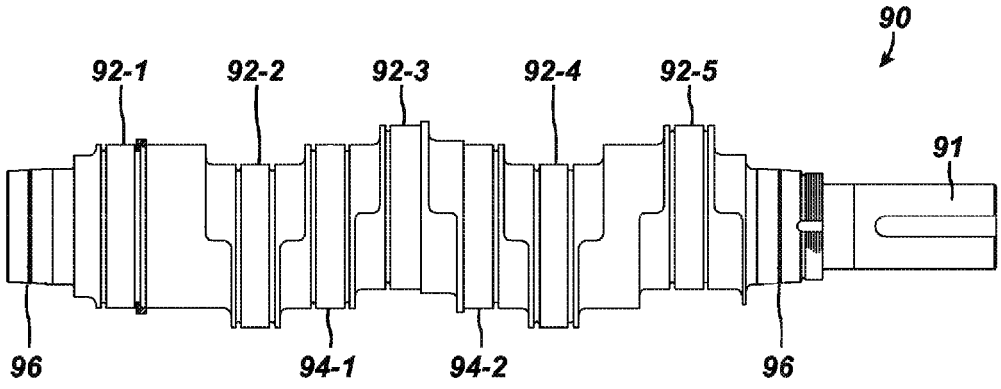
FIG. 4C (Prior Art)
FIG. 4C is an isolated view of another crankshaft having eccentric sheaves for use in a quintuplex well service pump.
Figure 5:
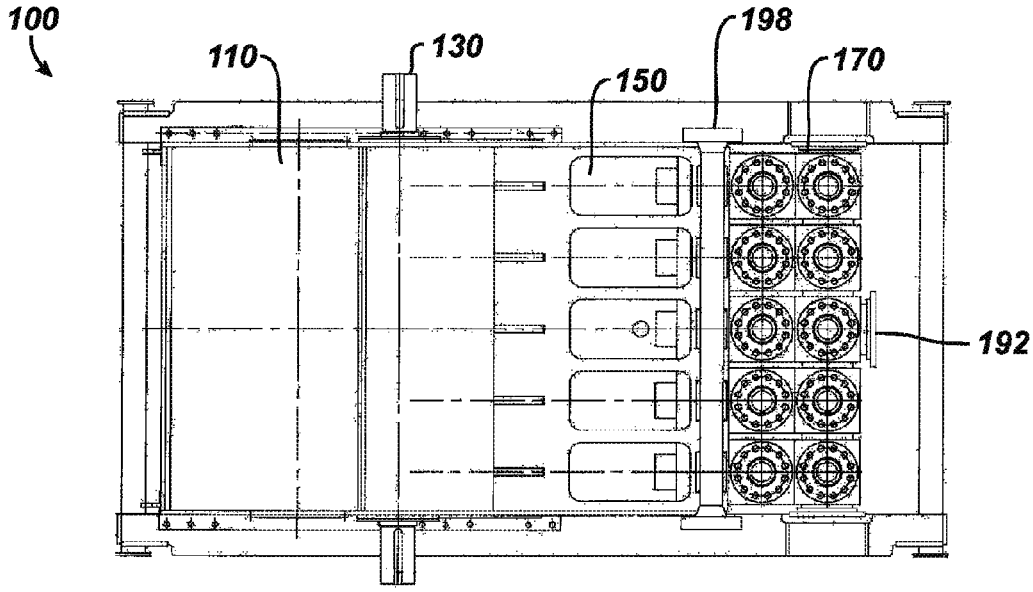
FIG. 5 is a top view of a quintuplex mud pump according to the present disclosure.
Figure 6A:
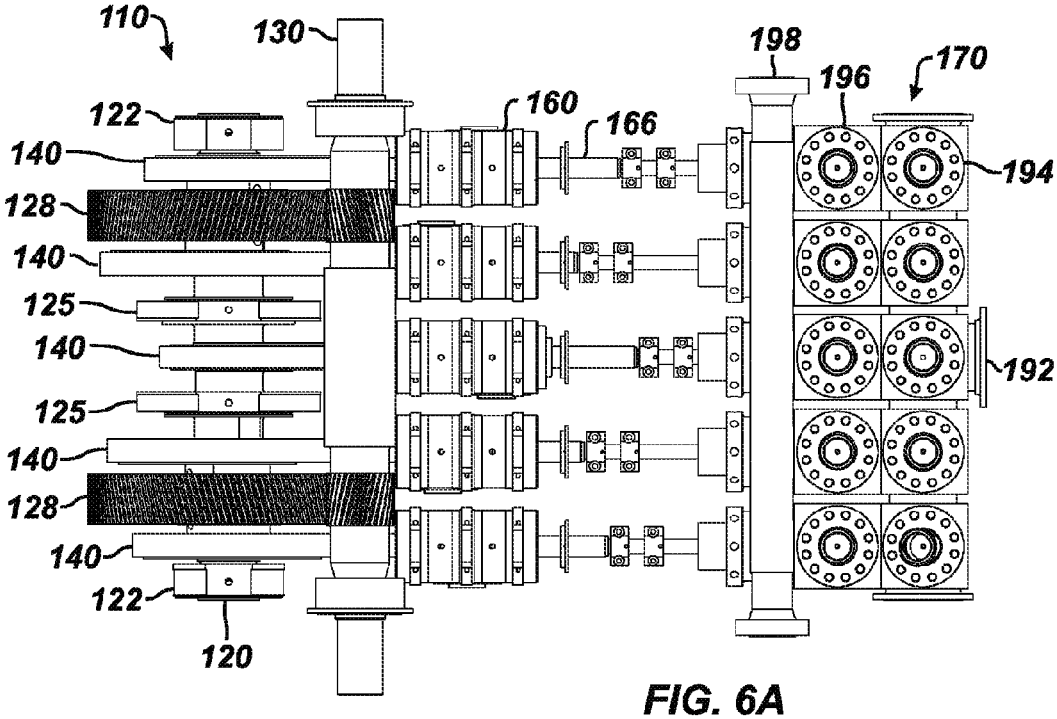
FIGS. 6A-6B are top and perspective views of the quintuplex mud pump of FIG. 5 showing internal components.
Figure 6B:
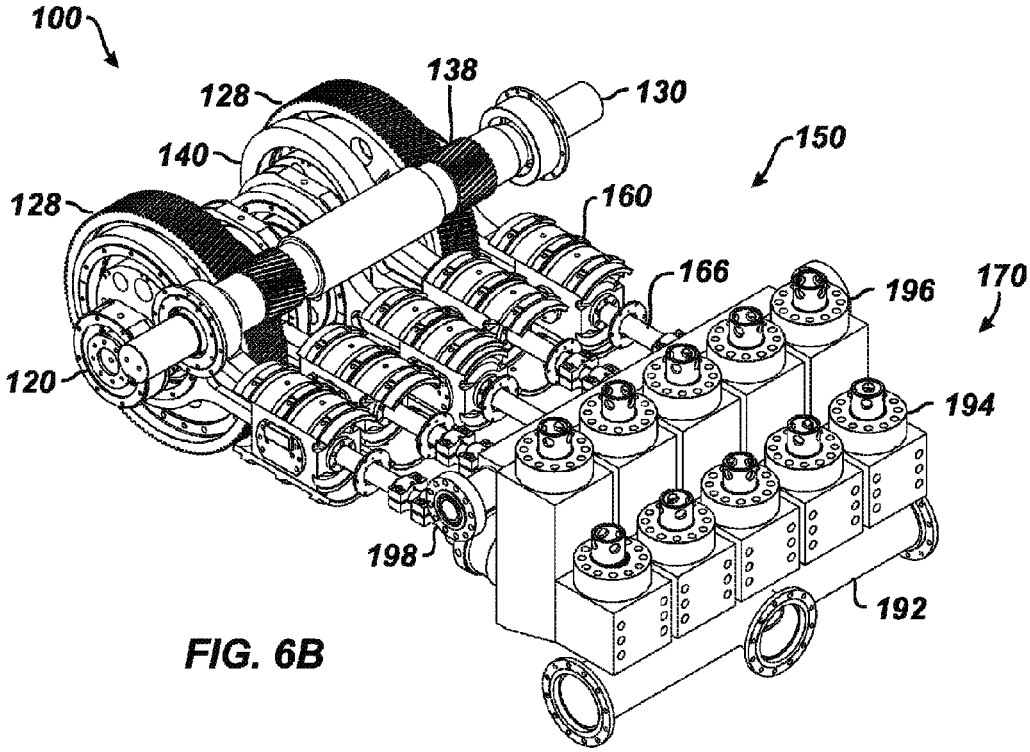

Turning to the drawings, a quintuplex mud pump 100 shown in FIGS. 5 and 6A-6B has a power assembly 110, a crosshead assembly 150, and a fluid assembly 170. Twin drives (e.g., electric motors, etc.) couple to ends of the power assembly's pinion shaft 130 to drive the pump's power assembly 110. As shown in FIGS. 6A-6B, internal gearing within the power assembly 110 converts the rotation of the pinion shaft 130 to rotation of a crankshaft 120. The gearing uses pinion gears 138 on the pinion shaft 130 that couple to bull gears 128 on the crankshaft 120 and transfer rotation of the pinion shaft 130 to the crankshaft 120.

For support, the crankshaft 120 has external main bearings 122 supporting its ends and two internal main bearings 127 supporting its intermediate extent in the assembly 110. As best shown in FIG. 6A, rotation of the crankshaft 120 reciprocates five independent connecting rods 140. Each of the connecting rods 140 couples to a crosshead 160 of the crosshead assembly 150. In turn, each of the crossheads 160 converts the connecting rod 40's movement into a reciprocating movement of an intermediate pony rod 166. As it reciprocates, the pony rod 166 drives a coupled piston or plunger (not shown) in the fluid assembly 170 that pumps mud from an intake manifold 192 to an output manifold 198. Being quintuplex, the mud pump 100 has five such pistons movable in the fluid assembly 170 for pumping the mud.

Figure 7:
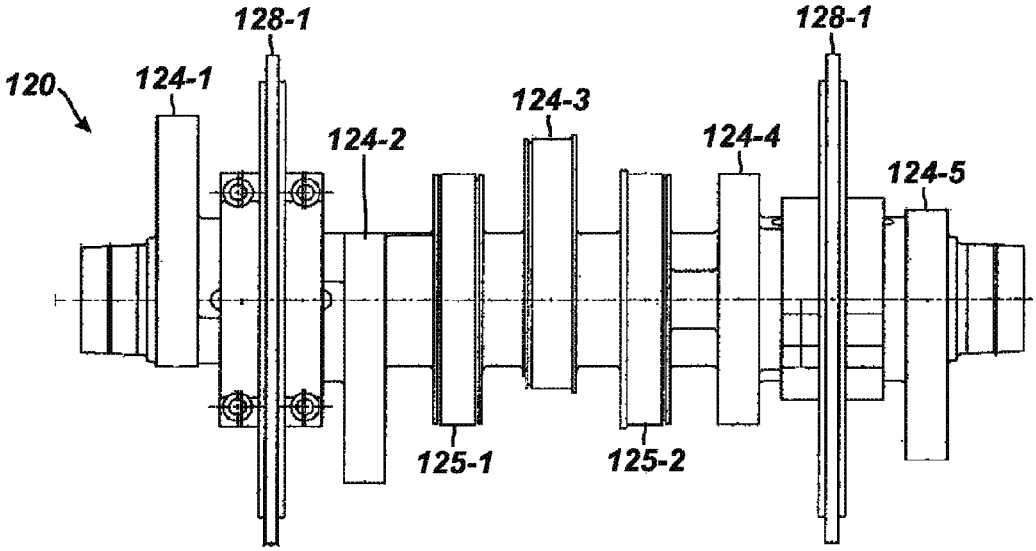
FIG. 7 is an isolated view of the pump's crankshaft.

Shown in isolated detail in FIG. 7, the crankshaft 120 has five eccentric sheaves 124-1 through 124-5 disposed thereon. Each of these sheaves can mechanically assemble onto the main vertical extent of the crankshaft 120 as opposed to being welded thereon. During rotation of the crankshaft 120, the eccentric sheaves actuate in a firing order of 124-1, 3, 5, 2 and 4 to operate the fluid assembly's pistons (not shown). This order allows the crankshaft 120 to be assembled by permitting the various sheaves to be mounted thereon. Preferably, each of the eccentric sheaves 124-1 . . . 124-5 is equidistantly spaced on the crankshaft 120 for balance.

The crankshaft 120 also has two internal main bearing sheaves 125-1 and 125-2 positioned respectively between the second and third sheaves 124-2 and 124-3 and the third and fourth sheaves 124-3 and 124-4. In the present embodiment, the crankshaft 120 also has two bull gear supports 128-1 and 128-2 disposed thereon, although one bull gear may be used by itself in other embodiments. The first bull gear support 128-1 is positioned between the first and second eccentric sheaves 124-1 and 124-2, and the second of the bull gear support 128-2 is positioned between the fourth and fifth eccentric sheaves 124-4 and 124-5.

Preferably, each of the sheaves 124-1 . . . 124-5, bull gear supports 128-1 & 128-2, and bearing sheaves 125-1 & 125-2 are equidistantly spaced on the crankshaft 120 for balance. In one implementation for the crankshaft 120 having a length a little greater than 90-in. (e.g., 90.750-in.), each of the sheaves 124, 125 and supports 128 are equidistantly spaced from one another by 9-inches between their rotational centers. The end sheaves 124-1 and 124-5 can be positioned a little over 9-in. (e.g., 9.375-in.) from the ends of the crankshaft 120.

Figure 8:
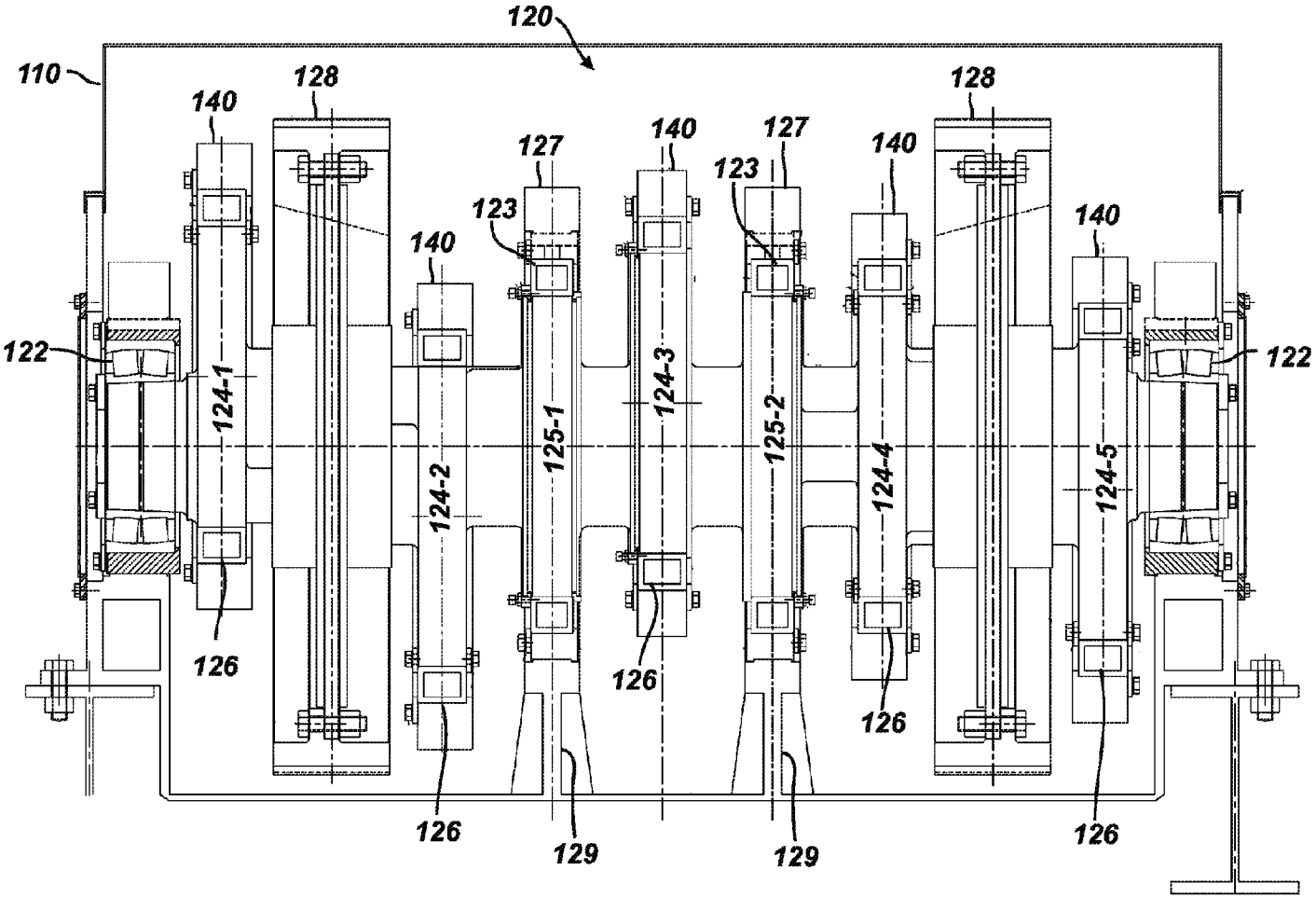
FIG. 8 is a cross-sectional view of the pump's power assembly showing the crankshaft and roller bearings.

The additional detail of FIG. 8 shows the crankshaft 120 supported in the power assembly 110 and having the connecting rods 140 mounted thereon. As noted above, double roller bearings 122 support the ends of the crankshaft 120 in the assembly 110. Internally, main bearings 123 support the intermediate extent of the crankshaft 120 in the assembly 110. In particular, the main bearings 126 position on the main bearing sheaves 125-1 and 125-2 and are supported by carriers 125 mounted to the assembly 110 at 129. The external main bearings 122 are preferably spherical bearings to better support radial and axial loads. The internal main bearings 125 preferably use cylindrical bearings.

Five connector rods 140 use roller bearings 126 to fit on the eccentric sheaves 124-1 . . . 124-5. Each of the roller bearings 126 preferably uses cylindrical bearings. The rods 140 extend from the sheaves 124-1 . . . 124-5 (perpendicular to the figure) and couple the motion of the crankshaft 120 to the fluid assembly (170) via crossheads (160) as is discussed in more detail below with reference to FIGS. 10A-10B.

Figure 9:
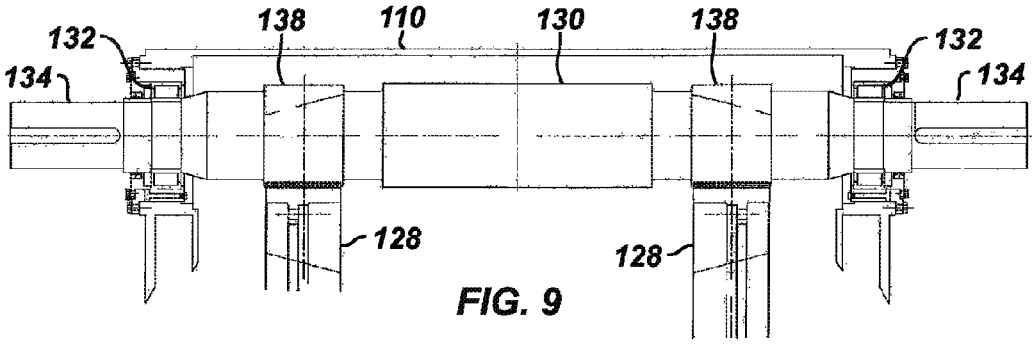
FIG. 9 shows the quintuplex mud pump's pinion shaft.

As shown in FIG. 9, the pinion shaft 130 mounts with roller bearings 132 in the power assembly 110 with its free ends 134 extending on both sides of the assembly 110 for coupling to drive components (not shown). As noted previously, the pinion gears 138 on the shaft 130 interface with the bull gears 128 on the crankshaft (120). Preferably, the interface uses helical gearing of opposite hand. In particular, the two pinion gears 138 on the pinion shaft 130 have helical teeth that have an opposite orientation or hand relative to one another. These helical teeth couple in parallel fashion to oppositely oriented helical teeth on the complementary bull gears 128 on the crankshaft 120. (The opposing orientation of helical teeth on the bull gears 128 and pinion gears 138 can best be seen in FIGS. 6A-6B). The helical gearing transfers rotation of the pinion shaft 130 to the crankshaft 120 in a balanced manner. In an alternative embodiment, the pinion shaft 130 can have one pinion gear 138, and the crankshaft 120 can have one bull gear 128. Preferably, these single gears 138/128 use herringbone or double helical gearing of opposite hand to avoid imparting axial thrust to the crankshaft 120.

Figure 10A:
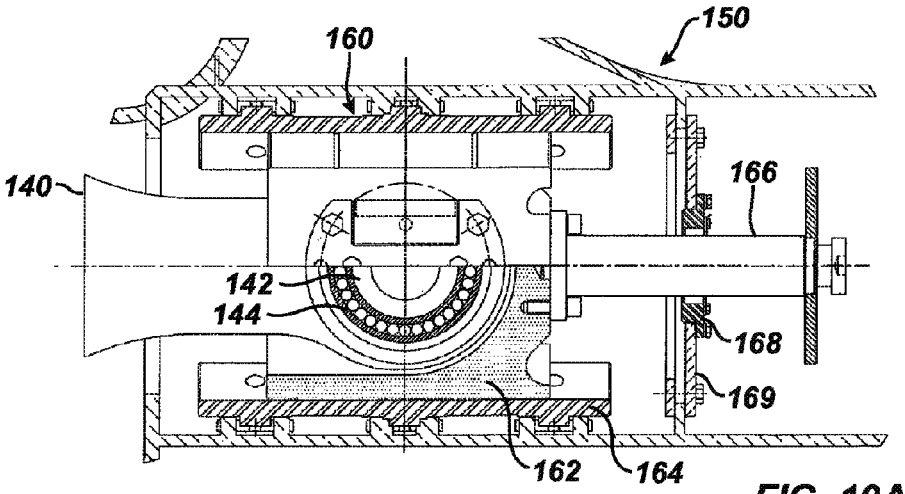
FIG. 10A shows a cross-section of a crosshead assembly for the quintuplex mud pump.

The cross-section in FIG. 10A shows a crosshead 160 for the quintuplex mud pump. The end of the connecting rod 140 couples by a wrist pin 142 and bearing 144 to a crosshead body 162 that is movable in a crosshead guide 164. A pony rod 166 coupled to the crosshead body 162 extends through a stuffing box gasket 168 on a diaphragm plate 169. An end of this pony rod 166 in turn couples to additional components of the fluid assembly (170) as discussed below.

Figure 10B:
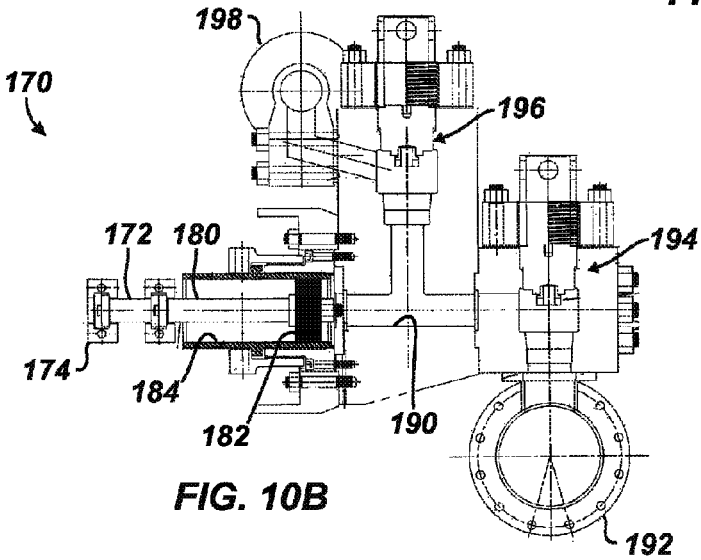
FIG. 10B shows a cross-section of a fluid assembly for the quintuplex mud pump.

The cross-section in FIG. 10B shows portion of the fluid assembly 170 for the quintuplex mud pump. An intermediate rod 172 has a clamp 174 that couples to the pony rod (166; FIG. 10A) from the crosshead assembly 160 of FIG. 10A. The opposite end of the rod 172 couples by another clamp to a piston rod 180 having a piston head 182 on its end. Although a piston arrangement is shown, the fluid assembly 170 can use a plunger or any other equivalent arrangement so that the terms piston and plunger can be used interchangeably herein. Moved by the pony rod (166), the piston head 182 moves in a liner 184 communicating with a fluid passage 190. As the piston 182 moves, it pulls mud from a suction manifold 192 through a suction valve 194 into the passage 190 and pushes the mud in the passage 190 to a discharge manifold 198 through a discharge valve 196.

As noted previously, a triplex mud pump produces a total flow variation of about 23%. Because the present mud pump 100 is quintuplex, the pump 100 offers a lower variation in total flow, making the pump 100 better suited for pumping mud and producing less noise that can interfere with MWD and LWD operations. In particular, the quintuplex mud pump 100 can produce a total flow variation as low as about 7%. For example, the quintuplex mud pump 100 can produce a maximum flow level of about 102% during certain crankshaft angles and can produce a minimum flow level of 95% during other crankshaft angles as the pump's five pistons move in their differing strokes during the crankshaft's rotation. Being smoother and closer to ideal, the lower total flow variation of 7% produces less pressure changes or "noise" in the pumped mud that can interfere with MWD and LWD operations.

Although a quintuplex mud pump is described above, it will be appreciated that the teachings of the present disclosure can be applied to multiplex mud pumps having at least more than three eccentric sheaves, connecting rods, and fluid assembly pistons. Preferably, the arrangement involves an odd number of these components so such mud pumps may be septuplex, nonuplex, etc. For example, a septuplex mud pump according to the present disclosure may have seven eccentric sheaves, connecting rods, and fluid assembly pistons with at least two bull gears and at least two bearing sheaves on the crankshaft. The bull gears can be arranged between first and second eccentric sheaves and sixth and seventh eccentric sheaves on the crankshaft. The internal main bearings supporting the crankshaft can be positioned between third and fourth eccentric sheaves and the fourth and fifth eccentric sheaves on the crankshaft.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A quintuplex mud pump, comprising:

a crankshaft rotatably supported in the pump by a plurality of main bearings, the crankshaft having five eccentric sheaves and a first bull gear disposed thereon, the main bearings including a first internal main bearing sheave disposed between the second and third eccentric sheaves and including a second internal main bearing sheave disposed between the third and fourth eccentric sheaves;

a pinion shaft for driving the crankshaft, the pinion shaft rotatably supported in the pump and having a first pinion gear interfacing with the first bull gear on the crankshaft; and five connecting rods, each of the connecting rods disposed on one of the eccentric sheaves of the crankshaft with a roller bearing.

2. A pump of claim 1, further comprising five pistons for pumping mud, each of the connecting rods coupled to one of the pistons.

3. A pump of claim 2, wherein each of the connecting rods couples to a crosshead by a wristpin, and wherein the crosshead couples to the piston.

4. A pump of claim 1, wherein the pinion shaft has opposing ends extending from the pump for coupling to drive components.

5. A pump of claim 1, wherein the first pinion gear and the first bull gear comprise herringbone gearing.

6. A pump of claim 1, wherein the crankshaft comprises a second bull gear disposed thereon, and wherein the pinion shaft comprises a second pinion gear disposed thereon and interfacing with the second bull gear.

7. A pump of claim 6, wherein the first bull gear is disposed between the first and second eccentric sheaves, and wherein the second bull gear is disposed between the fourth and fifth eccentric sheaves.

8. A pump of claim 6, wherein the five eccentric sheaves, the first and second internal main bearing sheaves, and the first and second bull gears are equidistantly spaced from one another on the crankshaft.

9. A pump of claim 6, wherein the first and second pinion gears comprise helical gearing of opposite hand, and wherein the first and second bull gears comprise helical gearing of opposite hand complementary to the pinion gears.

10. A pump of claim 1, wherein the main bearings comprise external main bearings disposed at ends of the crankshaft and each being a spherical bearing, each of the internal main bearing sheaves has a cylindrical bearing, and each of the roller bearings for the connecting rods has a cylindrical bearing.

11. A quintuplex mud pump, comprising:

a crankshaft rotatably supported in the pump by two external main bearings and two internal main bearings, the crankshaft having five eccentric sheaves, two internal main bearing sheaves for the internal main bearings, and at least one bull gear disposed thereon;

a pinion shaft rotatably disposed in the pump and having at least one pinion gear interfacing with the at least one bull gear on the crankshaft;

five connecting rods, each of the connecting rods using a roller bearing and disposed on one of the eccentric sheaves of the crankshaft; and five pistons for pumping mud, each of the connecting rods coupled to one of the pistons.

12. A pump of claim 11, wherein each of the connecting rods couples to a crosshead by a wristpin, and wherein the crosshead couples to the piston.

13. A pump of claim 11, wherein a first of the main bearing sheaves is disposed between the second and third eccentric sheaves, and wherein a second of the main bearing sheaves is disposed between the third and fourth eccentric sheaves.

14. A pump of claim 11, wherein the pinion shaft has opposing ends extending from the pump for coupling to drive components.

15. A pump of claim 11, wherein the at least one pinion gear and the at least one bull gear comprise herringbone gearing.

16. A pump of claim 11, wherein the at least one bull gear comprises first and second bull gears disposed on the crankshaft, and wherein the at least one pinion gear comprises first and second pinion gears disposed on the crankshaft.

17. A pump of claim 16, wherein the first bull gear is disposed between the first and second eccentric sheaves, and wherein the second bull gear is disposed between the fourth and fifth eccentric sheaves.

18. A pump of claim 16, wherein the five eccentric sheaves, the two internal main bearing sheaves, and the first and second bull gears are equidistantly spaced from one another on the crankshaft.

19. A pump of claim 16, wherein the first and second pinion gears comprise helical gearing of opposite hand, and wherein the first and second bull gears comprise helical gearing of opposite hand complementary to the pinion gears.

20. A pump of claim 11, wherein each of the two external main bearings is a spherical bearing, each of the two internal main bearings has a cylindrical bearing, and each of the roller bearings for the connecting rods has a cylindrical bearing.

21. A quintuplex mud pump, comprising:

a crankshaft rotatably supported in the pump by a plurality of main bearings, the crankshaft having five eccentric sheaves and first and second bull gears disposed thereon, the first bull gear disposed between the first and second eccentric sheaves, the second bull gear disposed between the fourth and fifth eccentric sheaves;

a pinion shaft for driving the crankshaft, the pinion shaft rotatably supported in the pump, the pinion shaft having a first pinion gear interfacing with the first bull gear on the crankshaft and having a second pinion gear interfacing with the second bull gear on the crankshaft; and five connecting rods, each of the connecting rods disposed on one of the eccentric sheaves of the crankshaft with a roller bearing.

22. A pump of claim 21, further comprising five pistons for pumping mud, each of the connecting rods coupled to one of the pistons.

23. A pump of claim 22, wherein each of the connecting rods couples to a crosshead by a wristpin, and wherein the crosshead couples to the piston.

24. A pump of claim 21, wherein the pinion shaft has opposing ends extending from the pump for coupling to drive components.

25. A pump of claim 21, wherein the first pinion gear and the first bull gear comprise herringbone gearing.

26. A pump of claim 21, wherein the main bearings include first and second internal main gearing sheaves disposed on the crankshaft, and wherein the five eccentric sheaves, the two internal main bearing sheaves, and the first and second bull gears are equidistantly spaced from one another on the crankshaft.

27. A pump of claim 21, wherein the first and second pinion gears comprise helical gearing of opposite hand, and wherein the first and second bull gears comprise helical gearing of opposite hand complementary to the pinion gears.

28. A pump of claim 21, wherein the main bearings comprise external main bearings disposed at ends of the crankshaft and each being a spherical bearing, the main bearings comprise internal main bearings disposed on the crankshaft and each having cylindrical bearings, and each of the roller bearings for the connecting rods has cylindrical bearings.

29. A quintuplex mud pump, comprising:

a crankshaft rotatably supported in the pump by a plurality of main bearings, the crankshaft having five eccentric sheaves and first and second bull gears disposed thereon, the main bearings including two internal main bearing sheaves disposed on the crankshaft, wherein the five eccentric sheaves, the two internal main bearing sheaves, and the first and second bull gears are equidistantly spaced from one another on the crankshaft;

a pinion shaft for driving the crankshaft, the pinion shaft rotatably supported in the pump, the pinion shaft having a first pinion gear interfacing with the first bull gear on the crankshaft and having a second pinion gear interfacing with the second bull gear on the crankshaft; and five connecting rods, each of the connecting rods disposed on one of the eccentric sheaves of the crankshaft with a roller bearing.

30. A pump of claim 29, further comprising five pistons for pumping mud, each of the connecting rods coupled to one of the pistons.

31. A pump of claim 30, wherein each of the connecting rods couples to a crosshead by a wristpin, and wherein the crosshead couples to the piston.

32. A pump of claim 29, wherein the pinion shaft has opposing ends extending from the pump for coupling to drive components.

33. A pump of claim 29, wherein the first pinion gear and the first bull gear comprise herringbone gearing.

34. A pump of claim 29, wherein the first and second pinion gears comprise helical gearing of opposite hand, and wherein the first and second bull gears comprise helical gearing of opposite hand complementary to the pinion gears.

35. A pump of claim 29, wherein the main bearings comprise external main bearings disposed at ends of the crankshaft and each being a spherical bearing, each of the two internal main bearing sheaves has a cylindrical bearing, and each of the roller bearings for the connecting rods has a cylindrical bearing.

* * * * *